US009235173B2

(12) United States Patent
Kasama

(10) Patent No.: US 9,235,173 B2
(45) Date of Patent: Jan. 12, 2016

(54) FIXING DEVICE AND IMAGE FORMING APPARATUS

(71) Applicant: KYOCERA Document Solutions Inc., Osaka (JP)

(72) Inventor: Kenichi Kasama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/560,318

(22) Filed: Dec. 4, 2014

(65) Prior Publication Data

US 2015/0177658 A1 Jun. 25, 2015

(30) Foreign Application Priority Data

Dec. 25, 2013 (JP) ..... 2013-266692

(51) Int. Cl.
*G03G 15/20* (2006.01)

(52) U.S. Cl.
CPC ..... *G03G 15/2053* (2013.01); *G03G 15/2064* (2013.01); *G03G 2215/2025* (2013.01); *G03G 2215/2035* (2013.01)

(58) Field of Classification Search
CPC ..... G03G 15/2053; G03G 2215/2035; G03G 15/2028; G03G 15/2064; G03G 2215/2032; G03G 15/2017; G03G 15/2032; G03G 15/2085; G03G 15/2039; G03G 15/657; G03G 15/2025; G03G 15/2042; G03G 15/206
See application file for complete search history.

(56) References Cited

U.S. PATENT DOCUMENTS

2012/0183325 A1* 7/2012 Sato et al. ..... 399/110
2014/0241767 A1* 8/2014 Egi ..... 399/329
2014/0241768 A1* 8/2014 Egi ..... 399/329
2014/0376979 A1* 12/2014 Egi ..... 399/329

FOREIGN PATENT DOCUMENTS

JP 2010-072480 A 4/2010

* cited by examiner

*Primary Examiner* — Roy Y Yi
(74) *Attorney, Agent, or Firm* — Studebaker & Brackett PC

(57) ABSTRACT

A fixing device includes a fixing belt, a pressuring member, a pressing member, a guiding member, a cap member, an elastic member and a detecting mechanism. The pressing member includes a pressing face pressing the fixing belt to a side of the pressuring member. The fixing belt includes a bulging part arranged at the downstream side from a fixing nip in a conveying direction. The cap member includes a facing part facing to the bulging part. Before the pressuring member comes into pressure contact with the fixing belt, a gap is arranged between the bulging part and facing part. When the pressuring member comes into pressure contact with the fixing belt, the bulging part bulges toward an external diameter side of the fixing belt to fill up the gap and the cap member is held by an end part of the fixing belt via the elastic member.

10 Claims, 9 Drawing Sheets

FIXING DEVICE AND IMAGE FORMING APPARATUS

INCORPORATION BY REFERENCE

This application is based on and claims the benefit of priority from Japanese Patent application No. 2013-266692 filed on Dec. 25, 2013, the entire contents of which are incorporated herein by reference.

BACKGROUND

The present disclosure relates to a fixing device fixing a toner image onto a recording medium and an image forming apparatus including the fixing device.

Conventionally, an electrographic image forming apparatus, such as a printer or a copying machine, forms a toner image onto a surface of a recording medium, such as a sheet, and then, heats and pressures the recording medium and toner image by a fixing device, thereby fixing the toner image onto the recording medium.

Recently, because requests of energy saving and shortening of a warm-up time are increased, reduction of a heat capacity of the fixing device is actively considered. As a concrete manner actualizing the reduction of a heat capacity of the fixing device, for example, there is a "slide belt manner". The fixing device with the slide belt manner includes a flexible fixing belt, a pressuring member coming into pressure contact with the fixing belt to form a fixing nip and a pressing member pressing the fixing belt toward a side of the pressuring member. Generally, when the pressuring member is rotated by a drive source connected to the pressuring member, the fixing belt is co-rotated with the rotation of the pressuring member and the fixing belt is slid with respect to the pressing member.

In the fixing device with the slide belt manner, when the operation fixing the toner image onto the recording medium is repeated, the pressing member is worn at a part of the pressing member coming into slide contact with the fixing belt and a sliding load of the fixing belt (a load required for sliding the fixing belt with respect to the pressing member) is increased. In addition, a surface of the fixing belt and a surface of the pressuring member are also deteriorated and drive force of the fixing belt (a co-rotational property of the fixing belt with respect to the pressuring member) is decreased. If these factors cause a slip between the pressuring member and fixing belt, it is impossible to co-rotate the fixing belt with rotation of the pressuring member, and therefore, there is a possibility that a part of the fixing belt is locally heated by a heat source. If such a situation occurs, there is a possibility that temperature of the part of the fixing belt is rapidly raised and the fixing belt is deformed.

A fixing device including a rotation detecting part detecting a rotation state of the fixing belt to prevent such a failure is disclosed. In such a conventional technique, a roller of the rotation detecting part comes into contact with an outer circumference face of the fixing belt. The roller is rotated simultaneously with the rotation of the fixing belt, and accordingly, the rotation state of the fixing belt may be detected.

However, in the above-mentioned conventional technique, in a case where paper dust, a toner and others are adhered onto the outer circumference face of the fixing belt or the roller or a case where a lubricant applied onto an inner circumference face of the fixing belt is spread to the outer circumference face of the fixing belt, a slip between the fixing belt and roller is caused, and then, it is difficult to surely detect the rotation state of the fixing belt by the rotation detecting part.

In the above-mentioned conventional technique, because the roller comes into contact with the outer circumference face of the fixing belt, there is a possibility that stress concentrates on a contact portion of the outer circumference face of the fixing belt and roller, and then, durability of the fixing belt is deteriorated.

SUMMARY

In accordance with an embodiment of the present disclosure, a fixing device includes a fixing belt, a pressuring member, a pressing member, a guiding member, a cap member, an elastic member and a detecting mechanism. The fixing belt is arranged rotatably around a rotation axis. The pressuring member is arranged rotatably to come into pressure contact with the fixing belt so as to form a fixing nip. The pressing member faces to the pressuring member across the fixing belt. The guiding member comes into contact with an inner circumference face of the fixing belt. The cap member is attached to an end part of the fixing belt. The elastic member is provided between the end part of the fixing belt and the cap member. The detecting mechanism detects rotation of the cap member. The pressing member includes a pressing face pressing the fixing belt to a side of the pressuring member. The pressing face is inclined to the side of the pressuring member toward a downstream side in a conveying direction of a recording medium. The fixing belt includes a bulging part arranged at the downstream side from the fixing nip in the conveying direction of the recording medium. The cap member includes a facing part facing to the bulging part. In a situation before the pressuring member comes into pressure contact with the fixing belt, the bulging part is separated from the facing part so that a gap is arranged in an area arranged between the bulging part and the facing part. When the pressuring member comes into pressure contact with the fixing belt, the bulging part bulges toward an external diameter side of the fixing belt to fill up the gap and the cap member is held by the end part of the fixing belt via the elastic member.

In accordance with an embodiment of the present disclosure, an image forming apparatus includes the above-mentioned fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
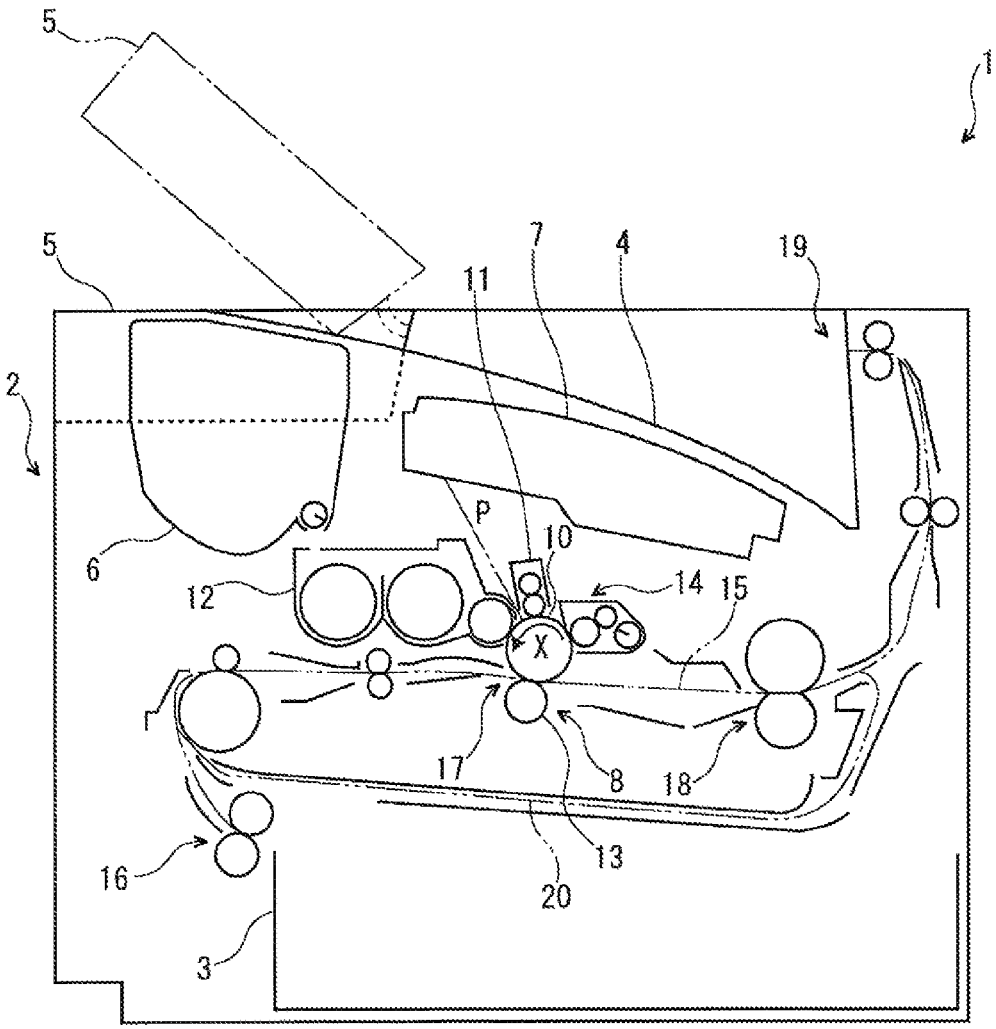
FIG. 1 is a schematic diagram schematically showing a printer according to a first embodiment of the present disclosure.

First, with reference to FIG. 1, the entire structure of a printer 1 (an image forming apparatus) will be described.

The printer 1 includes a box-like formed printer main body 2. In a lower part of the printer main body 2, a sheet feeding cartridge 3 storing sheets (recording mediums) is installed and, in a top face of the printer main body 2, an ejected sheet tray 4 is formed. To the top face of the printer main body 2, an upper cover 5 is openably/closably attached at a lateral side of the ejected sheet tray 4 and, below the upper cover 5, a toner container 6 is installed.

In an upper part of the printer main body 2, an exposure device 7 composed of a laser scanning unit (LSU) is located below the ejected sheet tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end in the conveying path 15, a sheet feeding part 16 is positioned. At an intermediate stream part in the conveying path 15, a transferring part 17 composed of the photosensitive drum 10 and transfer roller 13 is positioned. At a downstream part in the conveying path 15, a fixing device 18 is positioned. At a downstream end in the conveying path 15, a sheet ejecting part 19 is positioned. Below the conveying path 15, an inversion path 20 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer).

On the other hand, a sheet fed from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side in the conveying path 15 to be inserted to the fixing device 18, and then, the toner image is fixed onto the sheet in the fixing device 18. The sheet with the fixed toner image is ejected from the sheet ejecting part 19 to the ejected sheet tray 4. The toner remained on the photosensitive drum 10 is collected by the cleaning device 14.

Next, with reference to FIGS. 2-5, the fixing device 18 will be described.

Hereinafter, it will be described so that the front side of the fixing device 18 is positioned at the left side on FIG. 2, for convenience of explanation. An arrow Fr in FIG. 2 indicates the front side of the fixing device 18. An arrow I in FIG. 2 indicates an inner side in forward and backward directions, and an arrow O in FIG. 2 indicates an outer side in the forward and backward directions. An arrow Z in FIG. 3 indicates a conveying direction of the sheet (a direction from the left side to the right side in the embodiment).

Figure 2:
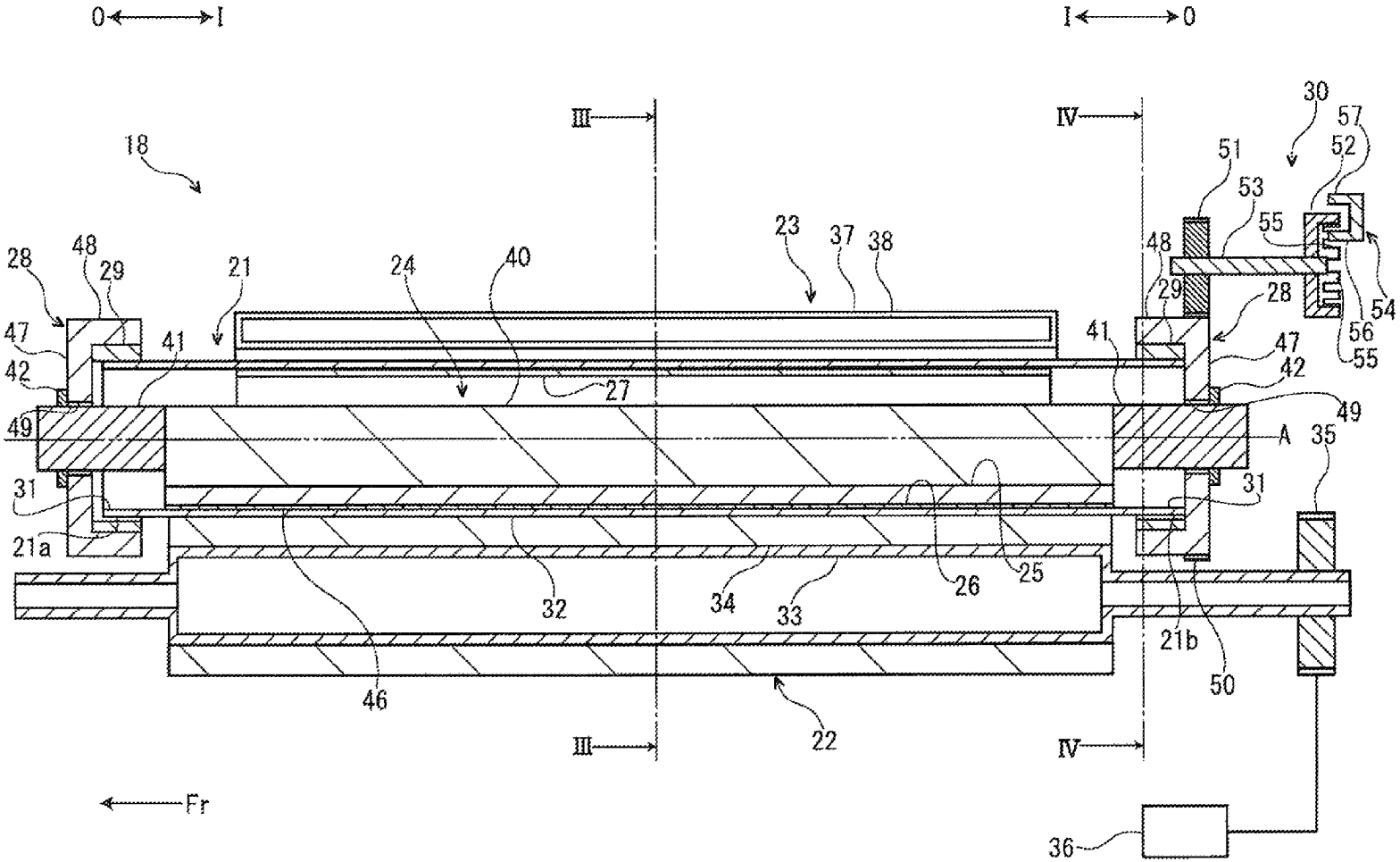
FIG. 2 is a lateral sectional view showing a fixing device in the printer according to the first embodiment of the present disclosure.

As shown in FIG. 2 and other figures, the fixing device 18 includes a fixing belt 21, a pressuring roller 22 (a pressuring member), an induction heating (IH) fixing unit 23, a supporting member 24, a pressing member 25, a sheet member 26, a guiding member 27, cap members 28, elastic members 29 and a detecting mechanism 30. The pressuring roller 22 is arranged below (outside) the fixing belt 21. The IH fixing unit 23 is arranged above (outside) the fixing belt 21. The supporting member 24 is arranged inside the fixing belt 21. The pressing member 25 is arranged below the supporting member 24 inside the fixing belt 21. The sheet member 26 is arranged below the pressing member 25 inside the fixing belt 21. The guiding member 27 is arranged above the supporting member 24 inside the fixing belt 21. The cap members 28 are respectively attached to both front and rear end parts 21*a* and 21*b* of the fixing belt 21. Each elastic member 29 is provided between each of the front and rear end parts 21*a* and 21*b* of the fixing belt 21 and each cap member 28. The detecting mechanism 30 is arranged at an upper backward side of the rear side cap member 28.

The fixing belt 21 is a flexible thin belt and is formed in a cylindrical shape elongated in the forward and backward directions. The fixing belt 21 has, for example, an external diameter $\phi$ of 20 mm-50 mm. The fixing belt 21 is arranged rotatably around a rotation axis A extending in the forward and backward directions. That is, in the embodiment, the forward and backward directions equal to a rotation axis direction of the fixing belt 21.

The fixing belt 21 is composed of, for example, a base material layer, an elastic layer provided around the base material layer and a release layer covering the elastic layer. The base material layer of the fixing belt 21 is, for example, made of nickel (Ni) with a thickness of 30 μm-50 μm or made of polyimide resin with a thickness of 50 μm-100 μm. In a case making the base material layer of the fixing belt 21 by polyimide resin, polyimide resin is mixed with metal power, such as copper (Cu), silver (Ag) or aluminum (Al). The elastic layer of the fixing belt 21 is made of, for example, a silicone rubber with a thickness of 100 μm-500 μm. The release layer of the fixing belt 21 is made of, for example, fluorine-based resin, such as perfluoro alkoxy alkane (PFA), with a thickness of 30 μm-50 μm. Each figure shows the respective layers (the base material layer, elastic layer and release layer) of the fixing belt 21 without distinguishing.

Figure 3:
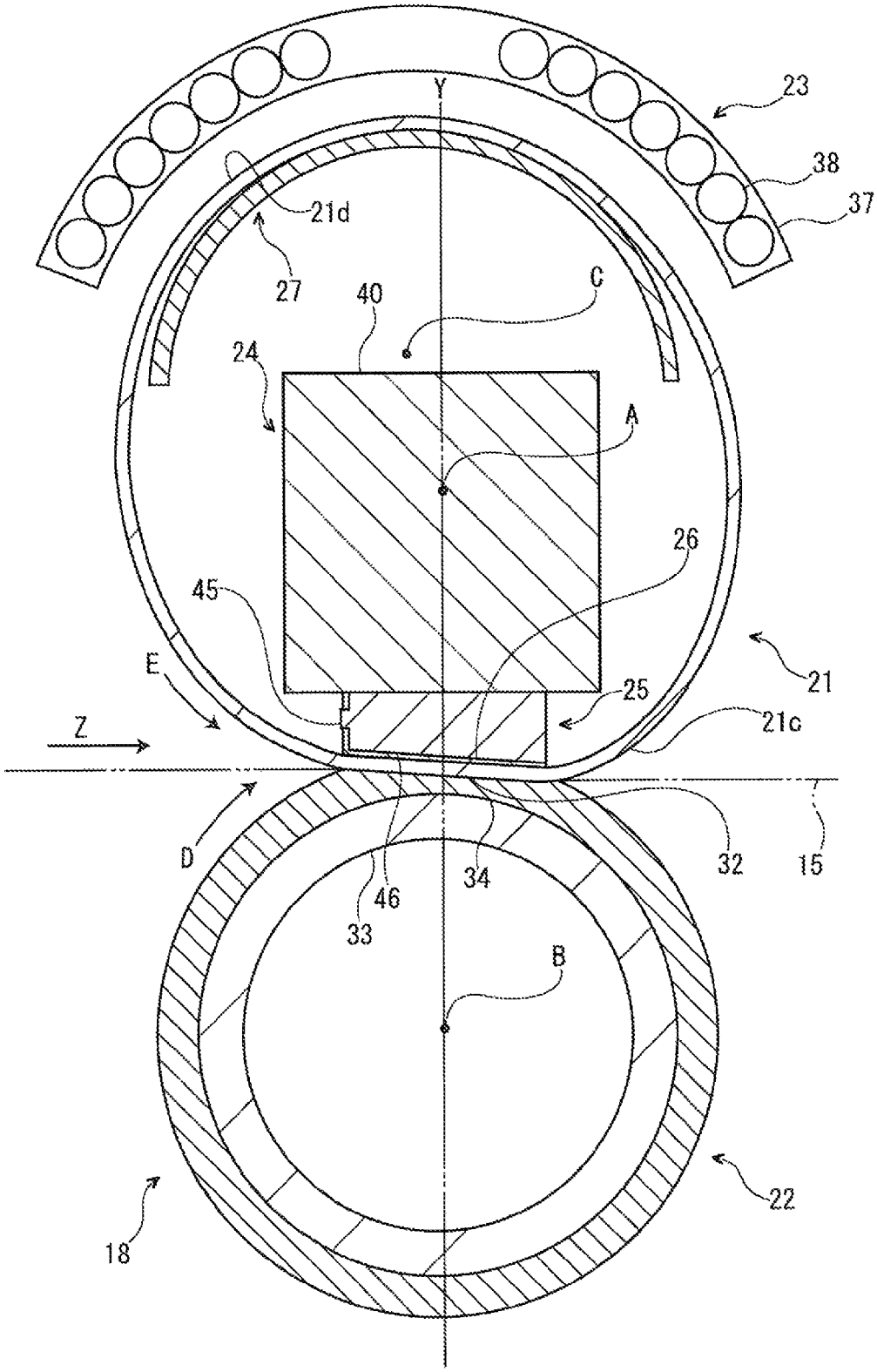
FIG. 3 is a sectional view taken along a line III-III of FIG. 2.

On the inner circumference face of the fixing belt 21, a coating made of polyimide, polyamidimide, polytetrafluoroethylene (PTFE) or the like is applied to a portion to be slid with respect to the sheet member 26. On the inner circumference face of the fixing belt 21, lubricant made of fluorine grease, a silicone oil or the like is applied to a portion to be slid with respect to the sheet member 26. In both front and rear end parts 21*a* and 21*b* of the fixing belt 21, openings 31 are formed. As shown in FIG. 3 and other figures, in a right lower part of the fixing belt 21, a bulging part 21*c* is formed. In a left upper part of the fixing belt 21, a first sandwiching part 21*d* is formed. The first sandwiching part 21*d* is arranged at an opposite side to the bulging part 21*c* across the rotation axis A of the fixing belt 21.

The pressuring roller 22 is rotatably supported by a fixing frame (not shown). The pressuring roller 22 is formed in a cylindrical shape elongated in the forward and backward directions. The pressuring roller 22 comes into pressure contact with the fixing belt 21, and thereby, between the fixing belt 21 and pressuring roller 22, a fixing nip 32 is formed. At a right side of the fixing nip 32 (at a downstream side in the conveying direction of the sheet), the bulging part 21*c* of the fixing belt 21 is arranged.

The pressuring roller 22 is composed of, for example, a cylindrical core material 33, an elastic layer 34 provided around the core material 33 and a release layer (not shown) covering the elastic layer 34. The core material 33 of the pressuring roller 22 is made of, e.g. metal, such as stainless steel or aluminum. As shown in FIG. 2, in a rear end part of the core material 33 of the pressuring roller 22, a drive gear 35 is fixed. The drive gear 35 is connected to a drive source 36 composed of a motor or the like. The elastic layer 34 of the pressuring roller 22 is made of, for example, a silicone rubber or a silicone sponge. The release layer of the pressuring roller 22 is made of, for example, fluorine-based resin, such as PFA.

As shown in FIG. 3 and other figures, the IH fixing unit 23 includes a case member 37 and an IH coil 38 (a heat source) housed in the case member 37. The IH coil is arranged in an arc shape along the outer circumference of the fixing belt 21. The IH coil 38 is located above the fixing belt 21 (at an opposite side to the fixing nip 32). The IH coil 38 is supplied with a high frequency current to generate a magnetic field.

As shown in FIG. 2, the supporting member 24 is extended in the forward and backward directions. The supporting member 24 penetrates the fixing belt 21. The supporting member 24 includes a fixation part 40 and shaft parts 41 arranged at both front and rear sides of the fixation part 40.

The fixation part 40 of the supporting member 24 is extended in the forward and backward directions. As shown in FIG. 3, the fixation part 40 has a rectangular shaped section.

Figure 4:
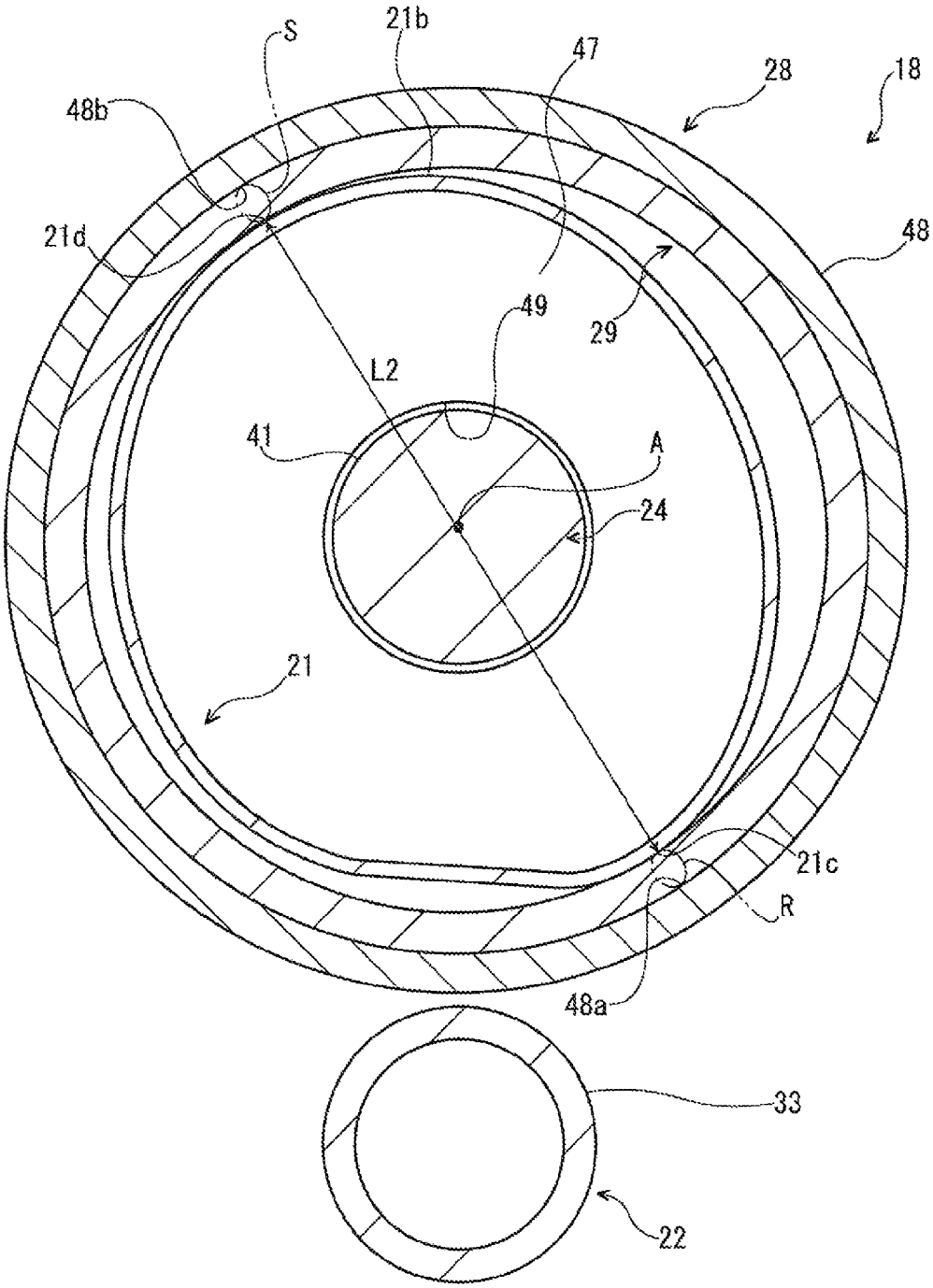
FIG. 4 is a sectional view taken along a line IV-IV of FIG. 2.

As shown in FIG. 2, each shaft part 41 of the supporting member 24 is extended in the forward and backward directions. An inner side end part in the forward and backward directions of each shaft part 41 is connected to the fixation part 40 of the supporting member 24. An outer side portion in the forward and backward directions of each shaft part 41 is projected to the outside in the forward and backward directions of the fixing belt 21 via each opening 31. To the outer side portion in the forward and backward directions of each shaft part 41, an annular shift stopping member 42 is fixed. An outer side end part in the forward and backward directions of each shaft part 41 is fixed to the fixing frame (not shown). As shown in FIG. 4, each shaft part 41 has a circular shaped section.

As shown in FIG. 2, the pressing member 25 is extended in the forward and backward directions. The pressing member 25 faces to the pressuring roller 22 via the fixing belt 21 and sheet member 26. The pressing member 25 is made of, for example, a heat resistant resin, such as liquid crystal polymer (LCP). An upper face of the pressing member 25 is fixed to a lower face of the fixation part 40 of the supporting member 24. Thereby, the pressing member 25 is supported by the supporting member 24.

As shown in FIG. 3, the pressing member 25 has a roughly rectangular shaped section. In a left face of the pressing member 25, a fixation protrusion 45 is formed. In a lower face of the pressing member 25, a pressing face 46 is formed. The pressing face 46 presses the fixing belt 21 via the sheet member 26 downwardly (to a side of the pressuring roller 22). The pressing face 46 is inclined downwardly (to the side of the pressuring roller 22) toward the right side (the downstream side in the conveying direction of the sheet). The pressing face 46 may has an elastomer layer, such as silicone rubber.

A left end part of the sheet member 26 is fixed to the fixation protrusion 45 of the pressing member 25. The sheet member 26 is provided between the fixing belt 21 and pressing member 25 to come into contact with the inner circumference face of the fixing belt 21. When the fixing belt 21 is rotated, the fixing belt 21 is slid with respect to the sheet member 26. The sheet member 26 is made of, for example, fluorine-based resin, such as PTFE, to have a friction coefficient smaller than that of the pressing member 25.

The guiding member 27 is supported by the supporting member 24. The guiding member 27 is curved in an arc shape toward the upper side (a side separating from the pressuring roller 22). A center C of the arc shape of the guiding member 27 is positioned at the left side (an upstream side in the conveying direction of the sheet) from a vertical line Y passing through the rotation axis A of the fixing belt 21 and a rotation center B of the pressuring roller 22. That is, the center C of the arc shape of the guiding member 27 is positioned at the left side (the upstream side in the conveying direction of the sheet) from the rotation axis A of the fixing belt 21 and the rotation center B of the pressuring roller 22. An outer circumference face of the guiding member 27 comes into contact with the inner circumference face of the fixing belt 21. The guiding member 27 together with the pressing member 25 stretches the fixing belt 21, and accordingly, the fixing belt 21 is deformed in a vertically long elliptic shape. The guiding member 27 is made of a material generating heat by the magnetic field generated by the IH coil 38 (e.g. magnetic shunt metal, such as Fe—Ni alloy). As shown in FIG. 2, each of front and rear end parts (each outer side end part in the forward and backward directions) of the guiding member 27 is positioned at an inner side in the forward and backward directions from an inner side end part in the forward and backward directions of each elastic member 29. Therefore, each portion of the fixing belt 21 outside the guiding member 27 in the forward and backward directions maintains an original shape by rigidity of the fixing belt 21 itself.

Each cap member 28 includes a annular main body part 47 and a flange part 48 protruded from an end part at an external diameter side of the main body part 47 to the inner side in the forward and backward directions.

The main body part 47 of each cap member 28 is positioned at an outer side in the forward and backward directions of each of the front and rear end parts 21*a* and 21*b* of the fixing belt 21. In a center part of the main body part 47, a circular through hole 49 is bored in the forward and backward directions and, into the through hole 49, each shaft part 41 of the supporting member 24 is loosely inserted. On an outer circumference of the main body part 47 of the rear side cap member 28, a first connecting gear 50 is arranged. At the outside in the forward and backward directions of the main body part 47 of each cap member 28, each shift stopping member 42 fixed to each shaft part 41 of the supporting member 24 is arranged. Thereby, movement to the outside in the forward and backward directions of each cap member 28 is restricted.

The flange part 48 of each cap member 28 is arranged so as to cover an external diameter side of each of front and rear end parts 21*a* and 21*b* of the fixing belt 21. As shown in FIG. 4 and other figures, in a right lower part of the flange part 48, a facing part 48*a* is arranged. The facing part 48*a* faces to the bulging part 21*c* of the fixing belt 21 and, between the facing part 48*a* and bulging part 21*c* of the fixing belt 21, each elastic member 29 is sandwiched. In a left upper part of the flange part 48, a second sandwiching part 48*b* is arranged. The second sandwiching part 48*b* is arranged at an opposite side to the facing part 48*a* across the rotation axis A of the fixing belt 21. The second sandwiching part 48*b* faces to the first sandwiching part 21*d* of the fixing belt 21 and, between the second sandwiching part 48*b* and first sandwiching part 21*d* of the fixing belt 21, each elastic member 29 is sandwiched. By the above-mentioned configuration, each cap member 28 is held by each of front and rear end parts 21*a* and 21*b* of the fixing belt 21 via each elastic member 29.

Each elastic member 29 has a cylindrical shape. Each elastic member 29 is made of, for example, a silicone rubber. The silicone rubber as a material of each elastic member 29 may be a solid or a sponge. That is, the silicone rubber as a material of each elastic member 29 may be a non-foamed body or a foamed body. Each elastic member 29 is positioned at the external diameter side of each of front and rear end parts 21*a* and 21*b* of the fixing belt 21. Each elastic member 29 is positioned at an internal diameter side of the flange part 48 of each cap member 28. An outer circumference face of each elastic member 29 is adhered (fixed) to an inner circumference face of the flange part 48 of each cap member 28.

As shown in FIG. 2, the detecting mechanism 30 includes a second connecting gear 51, a pulse plate 52 arranged at a back side of the second connecting gear 51, a connecting shaft 53 connecting the second connecting gear 51 and pulse plate 52, and a sensor 54 arranged at an upper backward side of the pulse plate 52.

The second connecting gear 51 is meshed with the first connecting gear 50 of the rear side cap member 28. On the pulse plate 52, shading parts 55 are arranged in a row in a circumference direction. The sensor 54 is, for example, a photo interrupter (PI) sensor to have a light emitting part 56 and a light receiving part 57.

In the fixing device 18 configured as mentioned above, in order to fix the toner image onto the sheet, the drive source 36 works to rotate the drive gear 35. When the drive gear 35 is thus rotated, the pressuring roller 22 is rotated integrally with the drive gear 35 (refer to an arrow D in FIG. 3). According to this, the fixing belt 21 coming into pressure contact with the pressuring roller is co-rotated with the rotation of the pressuring roller 22 (refer to an arrow E in FIG. 3).

In addition, in order to fix the toner image onto the sheet, the high frequency current is supplied to the IH coil 38. According to this, the IH coil 38 generates a magnetic field, this magnetic field acts on the fixing belt 21 to generate eddy current, and then, the fixing belt 21 generates heat by the eddy current. That is, the IH coil 38 heats the fixing belt 21. Moreover, the magnetic field generated by the IH coil 38 causes heat generation of the guiding member 27, and then, the guiding member 27 heats the fixing belt 21. In such a situation, when the sheet passes through the fixing nip 32, the sheet and toner image are heated and pressured, thereby fixing the toner image onto the sheet.

When the operation fixing the toner image onto the sheet is repeated, the sheet member 26 may be worn and a sliding load of the fixing belt 21 may be increased. In addition, a surface of the fixing belt 21 and a surface of the pressuring roller 22 also may be gradually deteriorated and drive force of the fixing belt 21 (a co-rotational property of the fixing belt 21 with respect to the pressuring roller 22) may be decreased. If these factors cause a slip between the pressuring roller 22 and fixing belt 21, the fixing belt 21 may not be co-rotated with rotation of the pressuring roller 22 and there is fear that an upper part of the fixing belt 21 may be locally heated by the IH coil 38. If such a situation occurs, temperature of the upper part of the fixing belt 21 may be rapidly raised and there is fear that the fixing belt 21 may be deformed. In the embodiment, the fixing belt 21 can be prevented from being locally heated as follows.

When the fixing belt 21 is rotated, each cap member 28 is co-rotated with the rotation of the fixing belt 21. When each cap member 28 is rotated, the first connecting gear 50 of the rear side cap member 28 is rotated and the second connecting gear 51 meshed with the first connecting gear 50 of the rear side cap member 28 is rotated. The rotation of the second connecting gear 51 is transmitted to the pulse plate 52 via the connecting shaft 53 to rotate the pulse plate 52. When the pulse plate 52 is rotated, a light emitted from the light emitting part 56 to the light receiving part 57 in the sensor 54 is intermittently cut off by the shading parts 55 of the pulse plate 52 and a light receiving amount of the light receiving part 57 of the sensor 54 is switched between High and Low alternately. Thereby, the detecting mechanism 30 detects the rotation of the rear side cap member 28. In this case, the heating of the fixing belt 21 by the IH coil 38 is performed.

On the other hand, when the fixing belt 21 is stopped, each cap member 28 is also stopped, and therefore, the detecting mechanism 30 does not detect the rotation of the rear side cap member 28. In this case, the heating of the fixing belt 21 by the IH coil 38 is stopped. Thereby, the fixing belt 21 is prevented from being locally heated.

Next, the deformation of the fixing belt 21 when making the pressuring roller 22 come into pressure contact with the fixing belt 21 will be described.

Figure 5:
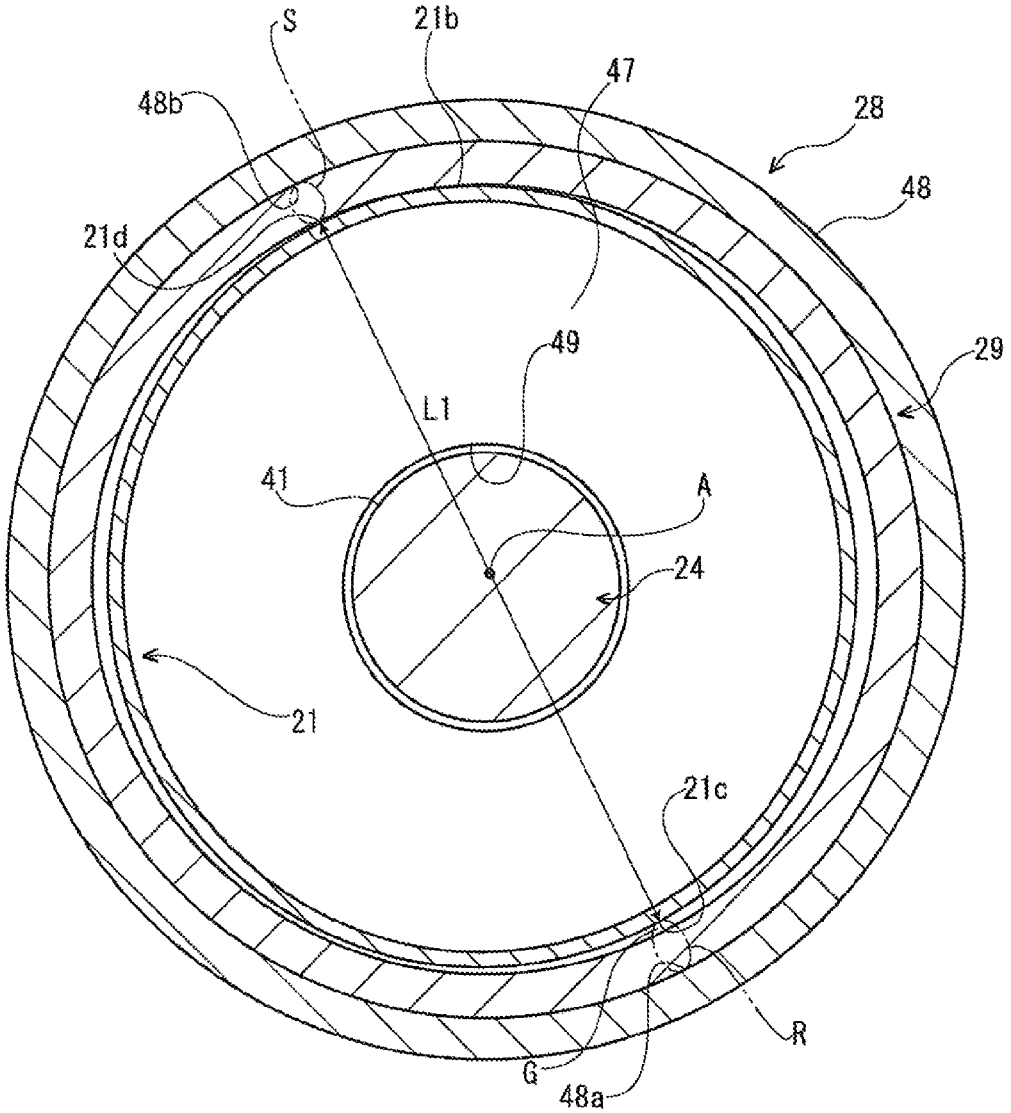
FIG. 5 is a sectional view showing the fixing device, in a situation before a pressuring roller comes into pressure contact with a fixing belt, in the printer according to the first embodiment of the present disclosure.

As shown in FIG. 5, in a situation before making the pressuring roller 22 (not shown in FIG. 5) come into pressure contact with the fixing belt 21, an external diameter L1 of the fixing belt 21 linking the bulging part 21*c* and first sandwiching part 21*d* is smaller than an internal diameter of each elastic member 29. Therefore, in an area R arranged between the bulging part 21*c* of the fixing belt 21 and the facing part 48*a* of each cap member 28, a gap G is arranged between the bulging part 21*c* of the fixing belt 21 and each elastic member 29. Incidentally, in an area S arranged between the first sandwiching part 21*d* of the fixing belt 21 and the second sandwiching part 48*b* of each cap member 28, it does not matter whether or not a gap is arranged between the first sandwiching part 21*d* of the fixing belt 21 and each elastic member 29.

By contrast, as shown in FIG. 3, when the pressuring roller 22 comes into pressure contact with the fixing belt 21 to form the fixing nip 32, because the pressing face 46 of the pressing member 25 is inclined downwardly (to the side of the pressuring roller 22) toward the right side (the downstream side in the conveying direction of the sheet), the bulging part 21*c* of the fixing belt 21 bulges toward the right lower side (an external diameter side of the fixing belt 21). According to this, as shown in FIG. 4, an external diameter L2 (a diameter at a longitudinal side) of the fixing belt 21 linking the bulging part 21*c* and first sandwiching part 21*d* becomes larger than the internal diameter of each elastic member 29 and the gap G in the above-mentioned area R is filled up. Incidentally, in a case where there is the gap in the above-mentioned area S in a situation before forming the fixing nip 32, this gap is also filled up. Alternatively, in a case where there is no gap in the above-mentioned area S, the state without the gap is maintained.

Therefore, the bulging part 21*c* and first sandwiching part 21*d* of the fixing belt 21 come into close contact with each elastic member 29 and each cap member 28 is held by each of the front and rear end parts 21*a* and 21*b* of the fixing belt 21 via each elastic member 29. Accordingly, it is possible to co-rotate each cap member 28 with the rotation of the fixing belt 21.

As described above, in the embodiment, with respect to the external diameter L1 of the fixing belt 21 linking the bulging part 21*c* and first sandwiching part 21*d* in the situation before making the pressuring roller 22 come into pressure contact with the fixing belt 21, the internal diameter of each elastic member 29 and the external diameter L2 (the diameter at the longitudinal side) of the fixing belt 21 linking the bulging part 21*c* and first sandwiching part 21*d* in the situation where the pressuring roller 22 comes into pressure contact with the fixing belt 21, there is a relationship of:

L1<the internal diameter of each elastic member 29<L2.

In accordance with the embodiment, as described above, in the situation before making the pressuring roller 22 come into pressure contact with the fixing belt 21, in the area R arranged between the bulging part 21*c* of the fixing belt 21 and the facing part 48*a* of each cap member 28, the gap G is arranged. Therefore, it is possible to easily attach each cap member 28 to each of the front and rear end parts 21*a* and 21*b* of the fixing belt 21 and to provide the fixing device 18 with excellent assemblability.

When the pressuring roller 22 comes into pressure contact with the fixing belt 21, the bulging part 21*c* of the fixing belt 21 bulges toward the right lower side (the external diameter side of the fixing belt 21) to fill up the gap G and each cap member 28 is held by each of the front and rear end parts 21*a* and 21*b* of the fixing belt 21 via each elastic member 29. By applying such a configuration, it is possible to surely co-rotate each cap member 28 with the rotation of the fixing belt 21. Therefore, it is possible to surely detect a rotation state of the fixing belt 21 through rotation detection of the rear side cap member 28.

Between each of the front and rear end parts 21*a* and 21*b* of the fixing belt 21 and each cap member 28, each elastic member 29 is provided. Therefore, as compared with a case where each cap member 28 comes into contact with each of the front and rear end parts 21*a* and 21*b* of the fixing belt 21, stress is unlikely to concentrate on the front and rear end parts 21*a* and 21*b* of the fixing belt 21. According to this, the fixing belt 21 is unlikely to be damaged and it is possible to improve durability of the fixing belt 21.

Each elastic member 29 is adhered (fixed) to the inner circumference face of the flange part 48 of each cap member 28. Therefore, it is possible to unify each elastic member 29 with each cap member 28 and to prevent each elastic member 29 from being shifted with respect to each cap member 28.

The center C of the arc of the guiding member 27 is positioned at the left side (the upstream side in the conveying direction of the sheet) from the rotation axis A of the fixing belt 21 and the rotation center B of the pressuring roller 22. Therefore, each cap member 28 is easily held by each of the front and rear end parts 21*a* and 21*b* of the fixing belt 21.

Each of front and rear end parts (each outer side end part in the forward and backward directions) of the guiding member 27 are positioned at the inner side in the forward and backward directions from each inner side end part in the forward and backward directions of each elastic member 29. Therefore, it is possible to avoid the front and rear end parts 21*a* and 21*b* of the fixing belt 21 from being caught between the guiding member 27 and each elastic member 29 and to restrain the front and rear end parts 21*a* and 21*b* of the fixing belt 21 from being worn.

Since each shift stopping member 42 is arranged at the outside in the forward and backward directions of the main body part 47 of each cap member 28, it is possible to restrict the movement to the outside in the forward and backward directions of each cap member 28 and to prevent the fixing belt 21 from meandering.

Since the outer circumference face of the guiding member 27 comes into contact with the inner circumference face of the fixing belt 21, it is possible to steady a rotation track of the fixing belt 21. Since the guiding member 27 is made of the material generating heat by the magnetic field generated by the IH coil 38, it is possible to improve the heating efficiency of the fixing belt 21.

The fixing device 18 includes a pressing member 25 pressing the fixing belt 21 downwardly (to the side of the pressuring roller 22) and a supporting member 24 supporting the pressing member 25. Therefore, it is possible to reduce heat capacity of the fixing device 18 and to immediately raise temperature of the fixing belt 21.

In the embodiment, a case of positioning the center C of the arc of the guiding member 27 at the left side (the upstream side in the conveying direction of the sheet) from the rotation axis A of the fixing belt 21 and the rotation center B of the pressuring roller 22 was described. However, in another embodiment, a position in left and right directions (the conveying direction of the sheet) of the center C of the arc of the guiding member 27 may correspond to positions in left and right directions (the conveying direction of the sheet) of the rotation axis A of the fixing belt 21 and the rotation center B of the pressuring roller 22.

In the embodiment, a case of inputting drive from the drive source 36 to the pressuring roller 22 was described. However, in another embodiment, the drive from the drive source 36 may be inputted to both the pressuring roller 22 and fixing belt 21.

In the embodiment, a case of using the IH coil 38 as the heat source was described. However, in another embodiment, another heater, such as a halogen heater or ceramic heater, may be used as the heat source.

In the embodiment, a case of applying the configuration of the present disclosure to the fixing device 18 with a manner sliding the fixing belt 21 with respect to the sheet member 26 was described. However, in another embodiment, the configuration of the disclosure may be applied to another fixing device 18 with a manner rotating the fixing belt 21 together with one or more rollers arranged at an inner diameter side of the fixing belt 21.

The embodiment was described in a case of applying the configuration of the present disclosure to the printer 1. However, in another embodiment, the configuration of the disclosure may be applied to another image forming apparatus, such as a copying machine, a facsimile or a multifunction peripheral.

Second Embodiment

Next, the fixing device 18 according to a second embodiment of the present disclosure will be described with reference to FIGS. 6 and 7.

In the first embodiment, the outer circumference face of each elastic member 29 is adhered (fixed) to the inner circumference face of the flange part 48 of each cap member 28. However, in the second embodiment, an inner circumference face of each elastic member 29 is adhered (fixed) to an outer circumference face of each of the front and rear end parts 21*a* and 21*b* of the fixing belt 21 (the rear end part 21*b* is shown in FIGS. 6 and 7). Other components in the second embodiment are configured similar to those of the first embodiment, so their explanation will be omitted.

Figure 7:
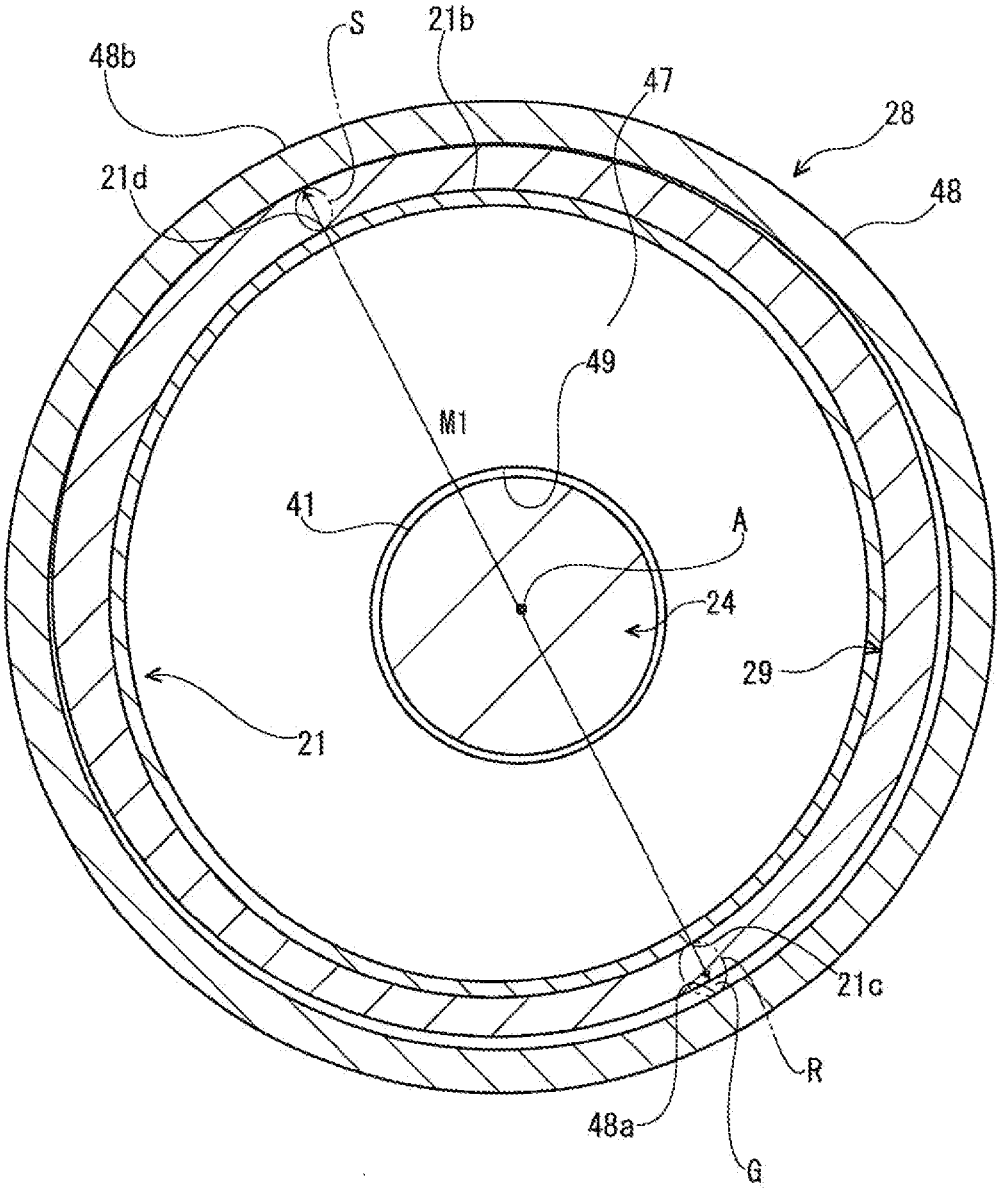
FIG. 7 is a sectional view showing the fixing device, in a situation before the pressuring roller comes into pressure contact with the fixing belt, in the printer according to the second embodiment of the present disclosure.

As shown in FIG. 7, in the situation before making the pressuring roller 22 (not shown in FIG. 7) come into pressure contact with the fixing belt 21, an external diameter M1 of each elastic member 29 is smaller than an internal diameter of each cap member 28. Therefore, in the area R arranged between the bulging part 21*c* of the fixing belt 21 and the facing part 48*a* of each cap member 28, a gap G is arranged between the facing part 48*a* of each cap member 28 and each elastic member 29.

Figure 6:
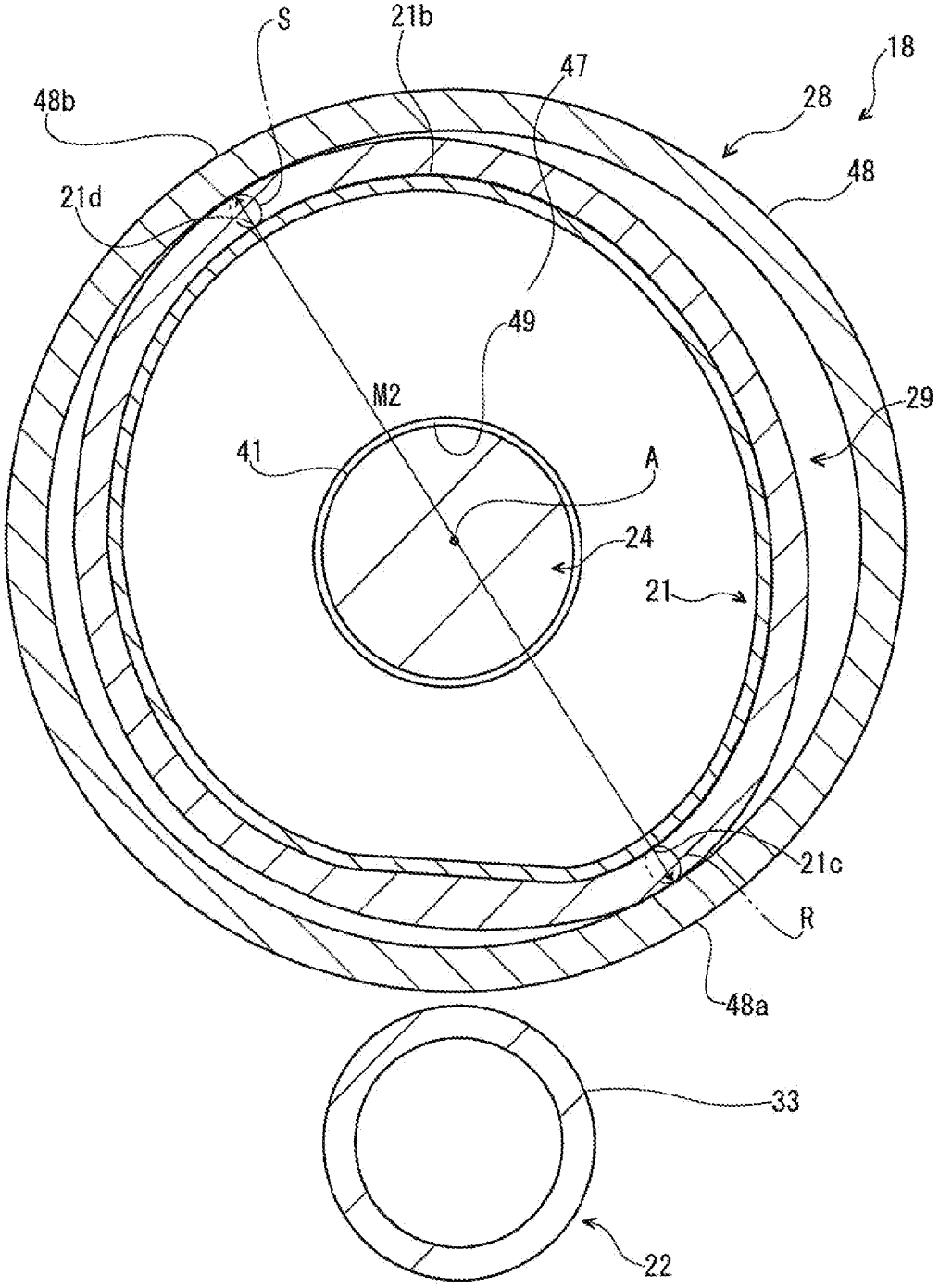
FIG. 6 is a sectional view showing the fixing device, in a situation where the pressuring roller comes into pressure contact with the fixing belt, in the printer according to a second embodiment of the present disclosure.

By contrast, when the pressuring roller 22 comes into pressure contact with the fixing belt 21 to form the fixing nip 32, as shown in FIG. 6, the bulging part 21*c* of the fixing belt 21 bulges toward the right lower side (the external diameter side of the fixing belt 21). According to this, a corresponding portion of each elastic member 29 to the bulging part 21*c* of the fixing belt 21 bulges toward the right lower side, an external diameter M2 (a diameter at a longitudinal side) of each elastic member 29 becomes larger than the internal diameter of each cap member 28 and the gap G in the area R is filled up. Accordingly, the corresponding portion of each elastic member 29 to the bulging part 21*c* of the fixing belt 21 comes into close contact with the facing part 48*a* of each cap member 28 and each cap member 28 is held by each of the front and rear end parts 21*a* and 21*b* of the fixing belt 21 via each elastic member 29. Therefore, it is possible to co-rotate each cap member 28 with the rotation of the fixing belt 21.

As described above, in the second embodiment, with respect to the external diameter M1 of each elastic member 29 in the situation before making the pressuring roller 22 come into pressure contact with the fixing belt 21, the internal diameter of each cap member 28 and the external diameter M2 (the diameter at the longitudinal side) of each elastic member 29 in the situation where the pressuring roller 22 comes into pressure contact with the fixing belt 21, there is a relationship of:

M1<the internal diameter of each cap member 28<M2.

In accordance with the second embodiment, as described above, the inner circumference face of each elastic member 29 is adhered (fixed) to the outer circumference face of each of the front and rear end parts 21*a* and 21*b* of the fixing belt 21. Therefore, it is possible to unify each elastic member 29 with each of the front and rear end parts 21*a* and 21*b* of the fixing belt 21 and to prevent each elastic member 29 from being shifted with respect to each of the front and rear end parts 21*a* and 21*b* of the fixing belt 21.

Third Embodiment

Next, the fixing device 18 according to a third embodiment of the present disclosure will be described with reference to FIGS. 8 and 9. Other components except for each elastic member 61 in the third embodiment are similar to those of the first embodiment, so their explanation will be omitted.

Each elastic member 61 includes a first elastic part 62 and a second elastic part 63 arranged at an outer diameter side of the first elastic part 62.

The first elastic part 62 has a cylindrical shape. The first elastic part 62 is made of, for example, a silicone rubber. An inner circumference face of the first elastic part 62 is adhered (fixed) to an outer circumference face of each of the front and rear end parts 21*a* and 21*b* of the fixing belt 21 (the rear end part 21*b* is shown in FIGS. 8 and 9). On an outer circumference face of the first elastic part 62, a first elastic gear 64 is arranged.

The second elastic part 63 has a cylindrical shape. The second elastic part 63 is made of, for example, a silicone rubber. An outer circumference face of the second elastic part 63 is adhered (fixed) to an inner circumference face of the flange part 48 of each cap member 28. On an inner circumference face of the second elastic part 63, a second elastic gear 65 is arranged.

Figure 9:
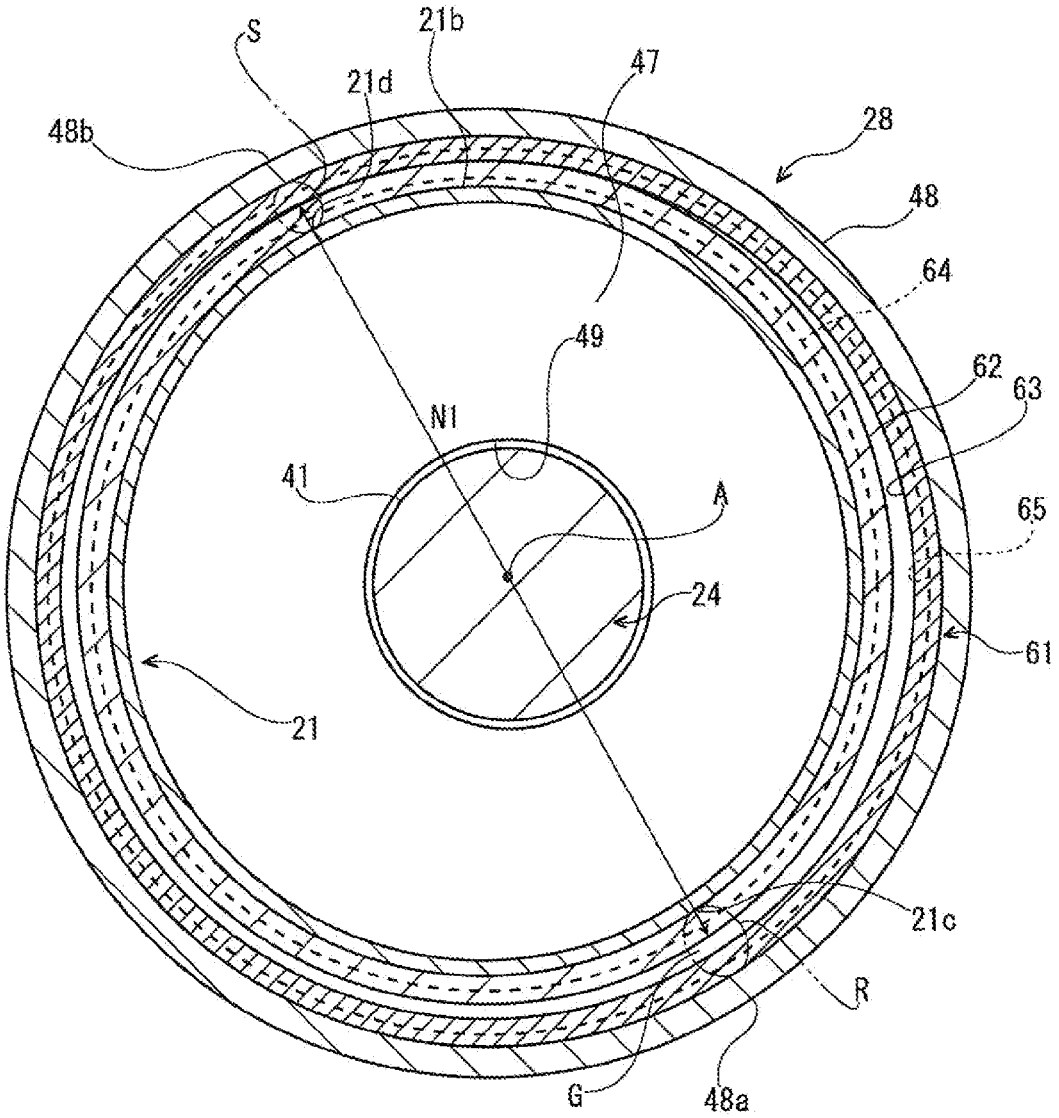
FIG. 9 is a sectional view showing the fixing device, in a situation before the pressuring roller comes into pressure contact with the fixing belt, in the printer according to the third embodiment of the present disclosure.

As shown in FIG. 9, in the situation before making the pressuring roller 22 (not shown in FIG. 9) come into pressure contact with the fixing belt 21, an external diameter N1 of the first elastic part 62 of each elastic member 61 is smaller than an internal diameter of the second elastic part 63 of each elastic member 61. Therefore, in the area R arranged between the bulging part 21*c* of the fixing belt 21 and the facing part 48*a* of each cap member 28, a gap G is arranged between the first elastic part 62 of each elastic member 61 and the second elastic part 63 of each elastic member 61. The first elastic gear 64 of the first elastic part 62 and the second elastic gear 65 of the second elastic part 63 are not meshed with each other.

Figure 8:
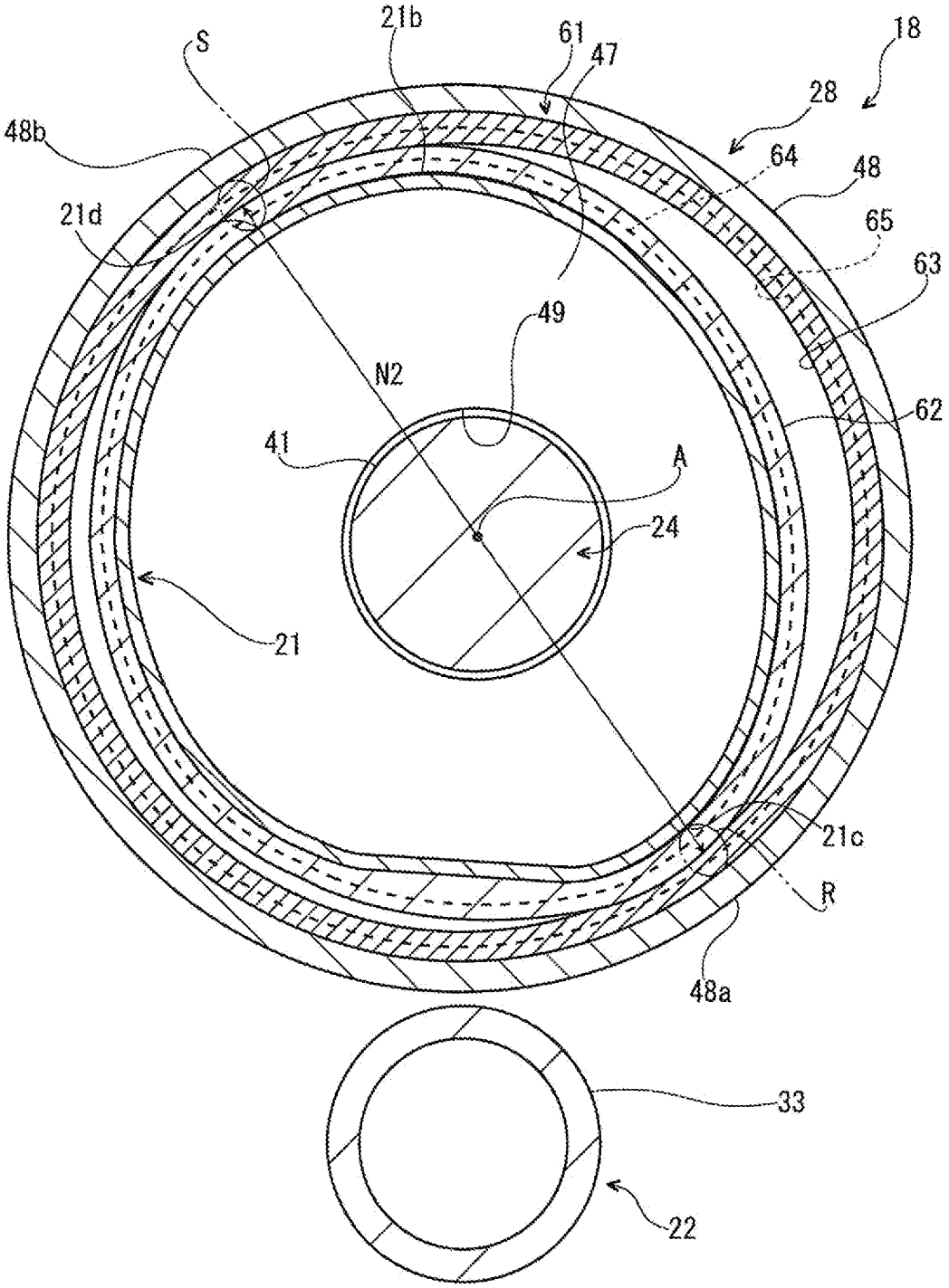
FIG. 8 is a sectional view showing the fixing device, in a situation where the pressuring roller comes into pressure contact with the fixing belt, in the printer according to a third embodiment of the present disclosure.

By contrast, when the pressuring roller 22 comes into pressure contact with the fixing belt 21 to form the fixing nip 32, as shown in FIG. 8, the bulging part 21*c* of the fixing belt 21 bulges toward the right lower side (the external diameter side of the fixing belt 21). According to this, a corresponding portion of the first elastic part 62 of each elastic member 61 to the bulging part 21*c* of the fixing belt 21 bulges toward the right lower side, an external diameter N2 (a diameter at a longitudinal side) of the first elastic part 62 of each elastic member 61 becomes larger than the internal diameter of the second elastic part 63 of each elastic member 61 and the gap G in the area R is filled up. Accordingly, the corresponding portion of the first elastic part 62 of each elastic member 61 to the bulging part 21*c* of the fixing belt 21 comes into close contact with a corresponding portion of the second elastic part 63 of each elastic member 61 to the facing part 48*a* of each cap member 28 and each cap member 28 is held by each of the front and rear end parts 21*a* and 21*b* of the fixing belt 21 via each elastic member 61. Therefore, it is possible to co-rotate each cap member 28 with the rotation of the fixing belt 21. The first elastic gear 64 of the first elastic part 62 and the second elastic gear 65 of the second elastic part 63 are meshed with each other.

As described above, in the third embodiment, with respect to the external diameter N1 of the first elastic part 62 of each elastic member 61 in the situation before making the pressuring roller 22 come into pressure contact with the fixing belt 21, the internal diameter of the second elastic part 63 of each elastic member 61 and the external diameter N2 (the diameter at the longitudinal side) of the first elastic part 62 of each elastic member 61 in the situation where the pressuring roller 22 comes into pressure contact with the fixing belt 21, there is a relationship of:

N1<the internal diameter of the second elastic part 63 of each elastic member 61<N2.

In the third embodiment, each elastic member 61 includes the first elastic part 62 adhered (fixed) to the outer circumference face of each of the front and rear end parts 21*a* and 21*b* of the fixing belt 21, and the second elastic part 63 adhered (fixed) to the inner circumference face of the flange part 48 of each cap member 28. By applying such a configuration, when the pressuring roller 22 comes into pressure contact with the fixing belt 21, the first elastic part 62 and second elastic part 63 come into close contact with each other. According to this, it is possible to enhance drive force for each cap member 28 (co-rotational property of each cap member 28 with respect to the fixing belt 21).

In the situation where the pressuring roller 22 comes into pressure contact with the fixing belt 21, the first elastic gear 64 arranged on the outer circumference face of the first elastic part 62 and the second elastic gear 65 arranged on the inner circumference face of the second elastic part 63 are meshed with each other. By applying such a configuration, it is possible to further enhance the drive force for each cap member 28 (the co-rotational property of each cap member 28 with respect to the fixing belt 21).

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A fixing device comprising:

a fixing belt arranged rotatably around a rotation axis;

a pressuring member arranged rotatably to come into pressure contact with the fixing belt so as to form a fixing nip;

a pressing member facing to the pressuring member across the fixing belt;

a guiding member coming into contact with an inner circumference face of the fixing belt;

a cap member attached to an end part of the fixing belt;

an elastic member provided between the end part of the fixing belt and the cap member; and a detecting mechanism detecting rotation of the cap member, wherein the pressing member includes a pressing face pressing the fixing belt to a side of the pressuring member, the pressing face being inclined to the side of the pressuring member toward a downstream side in a conveying direction of a recording medium, the fixing belt includes a bulging part arranged at the downstream side from the fixing nip in the conveying direction of the recording medium, the cap member includes a facing part facing to the bulging part, in a situation before the pressuring member comes into pressure contact with the fixing belt, the bulging part is separated from the facing part so that a gap is arranged in an area arranged between the bulging part and the facing part, when the pressuring member comes into pressure contact with the fixing belt, the bulging part bulges toward an external diameter side of the fixing belt to fill up the gap and the cap member is held by the end part of the fixing belt via the elastic member.

2. The fixing device according to claim 1, wherein the elastic member is fixed to an inner circumference face of the cap member, in the situation before the pressuring member comes into pressure contact with the fixing belt, the gap is arranged between the bulging part and the elastic member.

3. The fixing device according to claim 1, wherein the elastic member is fixed to an outer circumference face of the end part of the fixing belt, in the situation before the pressuring member comes into pressure contact with the fixing belt, the gap is arranged between the facing part and the elastic member.

4. The fixing device according to claim 1, wherein, the elastic member includes:

a first elastic part fixed to an outer circumference face of the end part of the fixing belt; and a second elastic part fixed to an inner circumference face of the cap member, in the situation before the pressuring member comes into pressure contact with the fixing belt, the gap is arranged between the first elastic part and the second elastic part.

5. The fixing device according to claim 4, wherein, the first elastic part has an outer circumference face on which a first elastic gear is arranged, the second elastic part has an inner circumference face on which a second elastic gear is arranged, the second elastic gear being meshed with the first elastic gear in a situation where the pressuring member comes into pressure contact with the fixing belt.

6. The fixing device according to claim 1, wherein, the guiding member is curved in an arc shape toward a side separating from the pressuring member, a center of the arc shape of the guiding member corresponds to or at an upstream side from the rotation axis of the fixing belt in the conveying direction of the recording medium.

7. The fixing device according to claim 1, wherein, an outer side end part in the rotation axis direction of the guiding member is positioned at an inner side in the rotation axis direction from an inner side end part in the rotation axis direction of the elastic member.

8. The fixing device according to claim 1, wherein, the cap member includes:

an annular main body part, and a flange part protruded from the main body part to an inner side in the rotation axis direction, the facing part is arranged in the flange part.

9. The fixing device according to claim 8, further comprising:

a shift stopping member arranged at the outer side in the rotation axis direction of the main body part.

10. An image forming apparatus comprising:

the fixing device according to claim 1.

* * * * *